US006460439B2

(12) United States Patent
Belanger

(10) Patent No.: US 6,460,439 B2
(45) **Date of Patent: *Oct. 8, 2002**

(54) INTEGRATED KNIFE ASSEMBLY

(75) Inventor: James Richard Belanger, Portsmouth, NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/185,544

(22) Filed: Nov. 4, 1998

(65) Prior Publication Data

US 2001/0002564 A1 Jun. 7, 2001

(51) Int. Cl.[7] ..... B36D 3/00

(52) U.S. Cl. ..... 83/13; 83/176; 83/155; 83/346; 83/674; 83/678; 83/343; 493/352; 271/188

(58) Field of Search ..... 83/155, 176, 346, 83/674, 678, 343; 493/369; 271/270, 204, 188

(56) References Cited

U.S. PATENT DOCUMENTS 3,483,780 A * 12/1969 Hudson ..... 83/81
3,784,188 A * 1/1974 De Ligt ..... 270/79
3,840,424 A * 10/1974 Morrison ..... 161/36
4,075,917 A * 2/1978 Kistner et al. ..... 83/422
4,227,952 A * 10/1980 Sabee ..... 156/164
4,448,621 A * 5/1984 Marsh et al. ..... 156/138
4,525,159 A * 6/1985 Filderman et al. ..... 474/201
4,983,155 A * 1/1991 Stobb ..... 493/369
5,037,365 A * 8/1991 Breton ..... 493/18
5,107,733 A 4/1992 Palmatier et al. ..... 83/176
5,135,461 A * 8/1992 Corey et al. ..... 493/7
5,186,444 A 2/1993 Palmatier et al. ..... 270/52.5
5,217,722 A * 6/1993 Ickinger et al. ..... 425/111
5,417,416 A * 5/1995 Marmin et al. ..... 271/270
5,615,878 A * 4/1997 Belanger et al. ..... 271/302
5,622,113 A * 4/1997 Hansen ..... 101/483
5,643,381 A * 7/1997 Iwafune et al. ..... 156/141
5,707,330 A * 1/1998 Kiamco et al. ..... 493/357
5,740,709 A * 4/1998 Boston et al. ..... 83/308
5,807,194 A * 9/1998 Knutson et al. ..... 474/268
5,921,906 A * 7/1999 Nagano ..... 493/353
5,971,879 A * 10/1999 Westhoff ..... 474/260
6,129,350 A * 10/2000 St. Ours ..... 271/204

* cited by examiner

*Primary Examiner*—Carl J. Arbes
*Assistant Examiner*—Minh Trinh
(74) *Attorney, Agent, or Firm*—Burns, Doane, Swecker & Mathis, LLP

(57) ABSTRACT

The present invention is related to an apparatus for cutting webs of material, including a first revolving member and a second revolving member having cutting elements integrated therein. Said revolving members, respectively, define a cutting region therebetween and supporting elements, respectively, assigned to said revolving elements within said cutting region. Said second revolving member comprises a belt assembly having a layered structure, said cutting elements mounted within said layered structure.

26 Claims, 7 Drawing Sheets

20
19
23.1
9
8
10
42
3
1
40
41
44
43
41
22
12
23
22
13
43
15
44
11
42
10
24
25

INTEGRATED KNIFE ASSEMBLY

FIELD OF THE INVENTION

The present invention is related to an knife assembly which is integrated into a rotating surface travelling about an endless path.

BACKGROUND OF THE INVENTION

U.S. Pat. No. 5,107,733 is related to an apparatus for cutting and transporting a paper web in a folding apparatus of the printing press.

An apparatus for transporting a web in a printing press comprises a pair of cutting cylinders for cutting web sections from the web and a transporting device for transporting the web sections away from the cutting cylinders. The first cutting cylinder has at least one cutting anvil and the second cutting cylinder has at least one cutting knife which meets the cutting anvil at a nip between the cutting cylinders to cut the web moving through the nip. A plurality of strips are supported on the first cutting cylinder and a plurality of strips are supported on the second cutting cylinder. The strips have positions on the cutting cylinders in which they impress a temporary reinforcing profile onto each newly formed leading portion of the web, when the strips move through the nip. At least one smoothing surface is supported on the first cutting cylinder and at least one smoothing surface is supported on the second cutting cylinder. The smoothing surfaces have positions on the cutting cylinders wherein the smoothing surfaces remove the temporary reinforcing profile from the leading portion of the web when the smoothing surfaces move through the nip. In this known solution, said knife assembly is integrated into grooves assigned to a cutting cylinder of a pair of cutting cylinders.

U.S. Pat. No. 5,186,444 is related to a method and device for assuring orderly web travel in a folder by punching holes in a paper width direction.

A method of assuring orderly web travel in a folder includes stamping out of layer structure formed of mutually super-imposed web surface portions along respective strips thereof, a plurality of tongue-like elements remain appendant to the web surface portions and projecting through respective holes simultaneously stamped out of the web surface portions, so as thereby to hold the web surface portions together at the respective strips thereof and a device for performing the method. Again in this known solution, cutting knife assemblies are assigned to a pair of cutting cylinders integrated into grooves laterally extending on the surface of the respective cutting cylinder.

There is a need to enhance cutting performance by constraining the incoming web of material prior to the cutting operation and after the cutting operation. Several attempts have been undertaken to improve cutting performance by using other materials, to improve the geometry of the device, and improve cutting dynamics. Attempts have been made to use electrostatic tackers and to corrugate the signature in order to stiffen it appropriately.

SUMMARY OF THE INVENTION

In view of the prior art and the problems encountered in the technical field it is accordingly an object of the present invention to constrain signatures upon creation and during transport out of the cutting region.

A further object of the present invention is to provide for a cyclic activation of cutting elements integrated into a revolving transport system.

According to the present invention an apparatus for cutting webs of material includes a first revolving member, a second revolving member having cutting elements integrated therein, said revolving members defining a cutting region therebetween, and supporting elements assigned to said revolving elements within said cutting region.

Advantageous with the present invention is the elimination of relative movements of the created signature after being severed from the incoming web; there are no more relative movements between the cut signature and the transport belt. The signature severed will be forwarded in a precise position to further downstream transport systems. By having a supporting element assigned to said revolving members, it is ensured that cooperating knives and anvils are supported upon a cutting operation to obtain a precise lateral cut and a high quality signature.

According to further details of the present invention, said first revolving member is a transport belt revolving about an endless loop. Said second revolving member is a layered structure, discussed in greater detail below and likewise revolving about an endless loop. To provide for a support of said first and second revolving members rotating supporting elements are tied in to an endless loop, the revolving members moving about deviation rollers. Said second revolving member comprises openings, through which each cutting element being integrated into the layered structure thereof protrudes and severs a signature upon a cutting operation.

Said first and second revolving members, respectively, have a multi component structure. Said first revolving member may comprise a plurality of laterally extending cut rubber portions, mounted into laterally extending grooves in said belt-shaped first revolving member. Said second revolving member may include a belt assembly comprising a substrate base layer. Said substrate base layer either may have a flat surface for contacting a rotating supporting element or may be shaped as a toothed surface contacting said outer circumference of said supporting element upon a cutting operation. Said substrate base layer may comprise a reinforcing member, which extends into longitudinal direction of said substrate base layer, i.e. parallel to the transport direction of said signature. A reinforcing member may be shaped as a cord or as fibres, such as Kevlar fibres.

Said second revolving member having a multi layered structure includes a mounting groove for said cutting elements which may be shaped as a T-slot, or a lateral groove for a knife base of the respective cutting element. Said mounting groove either may be arranged on top of said substrate layer, or on the bottom thereof to receive the respective knife base for ensuring safe mounting of said cutting elements. On top of said substrate layer a compressible layer may be arranged, being compressible upon contact with an opposite surface allowing for protrusion of said cutting elements integrated into said second revolving member.

The cutting elements may be shaped as having a spring-like base which allows for a protruding movement of said knife tip upon contact of the knife base with the respective surface of said second supporting element being integrated into the endless loop of said second revolving member.

BRIEF DESCRIPTION OF THE DRAWINGS

The novel features which are considered as characteristic for the invention are set forth in particular in the appended claims. The invention itself, however, both as to its construction and its method of operation together with additional objects and advantages thereof, will be best understood from the following description of a specific embodiment when read in connection with the accompanying drawings in which.

DESCRIPTION OF PREFERRED EMBODIMENTS

Figure 1:
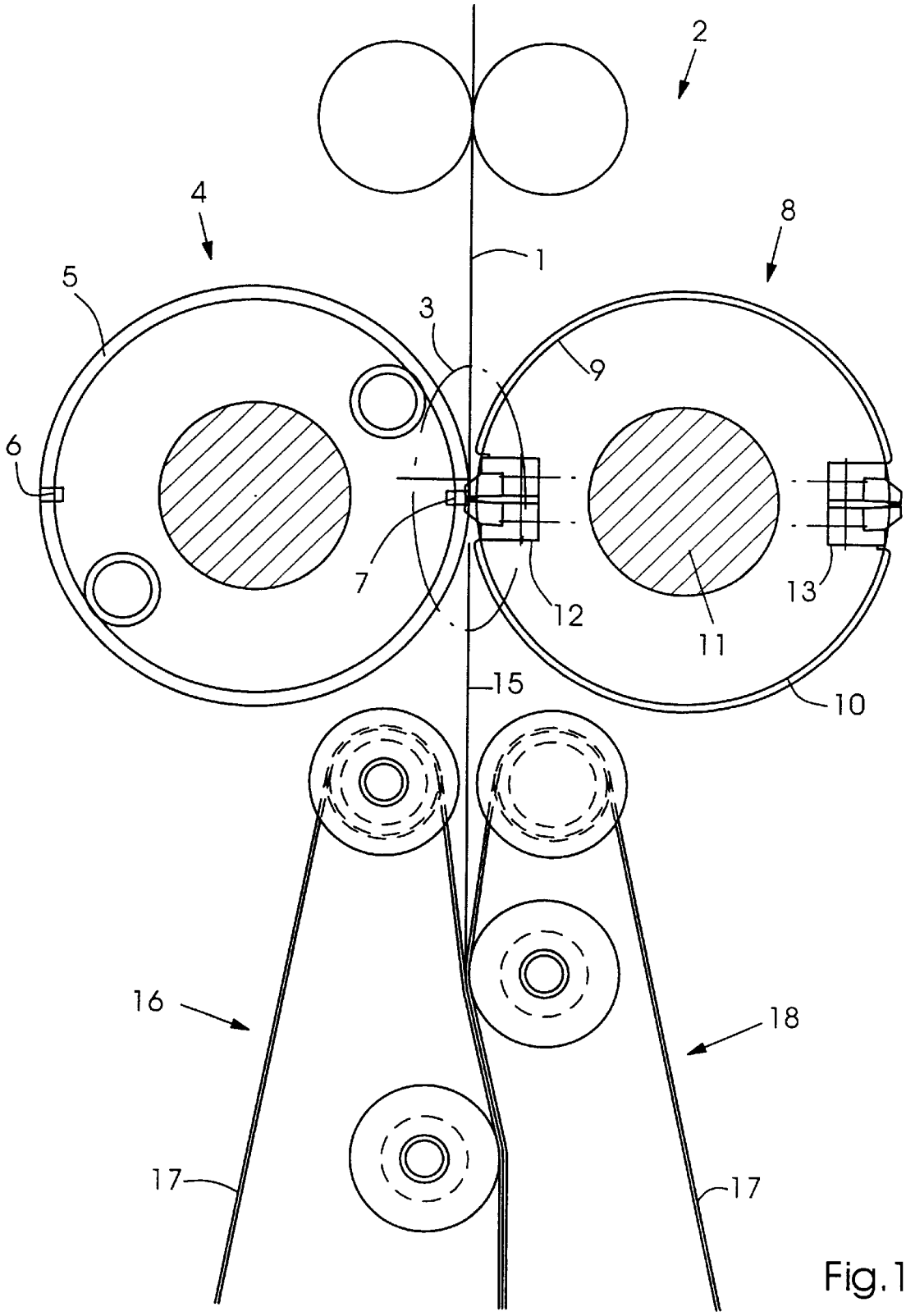
FIG. 1 is an existing cutting cylinder pair design, the anvil cylinder having anvil bars assigned thereto and FIG. 2 a transport belt having cutting rubber portions assigned thereto, FIG. 3*a* a cutting region defined by two downstream travelling belts being supported by each being supported by a first and a second supporting element, respectively, FIG. 3*b* the cutting region of FIG. 3 is given in an enlarged scale, FIG. 4 the respective loops along which said belts according to FIGS. 3*a* and 3*b* travel, FIG. 5*a* first embodiment of the knife being mounted in a T-slot of a substrate of a belt assembly, FIG. 5*b* the knife being notched along a reinforcing member extending through a substrate layer of said belt assembly, FIG. 5*c* a cross section of the knife mounting according to FIG. 5*b*, FIG. 6*a* the knife being mounted in a lateral groove extending in a substrate layer of said belt assembly according to the present invention, FIG. 6*b* a knife assembly being mounted in a lateral groove assigned to a substrate layer of said belt assembly according to the present invention during a cutting operation.

FIG. 1 shows an existing cutting cylinder pair design, the anvil cylinder having anvil bars assigned thereto.

An incoming web of material 1 is forwarded into a cutting region 3 by a pair of nip rollers 2 arranged above a cutting cylinder pair including an anvil cylinder 4 and a knife cylinder 8. Said knife cylinder 8 includes two knife assemblies, a first knife assembly 12 and a second knife assembly 13. Between said first and second knife assemblies 12, 13, respectively, surface jackets 10 are assigned to the circumference 9 of said knife cylinder 8. Furthermore, a cam segment 14 is arranged on a front portion of said knife cylinder 8. Said first and second knife assemblies 12, 13, respectively, are arranged opposite to one another, thus severing two signatures from the incoming web of material 1 upon a complete revolution thereof. Said anvil cylinder 4 has two rectangularly shaped anvil bars, a first anvil bar 6 and a second anvil bar 7 cooperating with said first and second knife assemblies 12, 13, respectively, of said knife cylinder 8. Said first and second anvil bars 6, 7 are arranged opposite to one another. Within a cutting region 3, signatures 15 are severed from said incoming web of material 1, said signatures 15 transferred to a transporting system including a left transport system 16 and a right transport system 18. Both transport systems 16, 18 respectively have revolving belts 17 assigned thereto for further transportation of said signatures 15, continuously being severed from the incoming web of material 1 within said cutting region 3.

Figure 2:
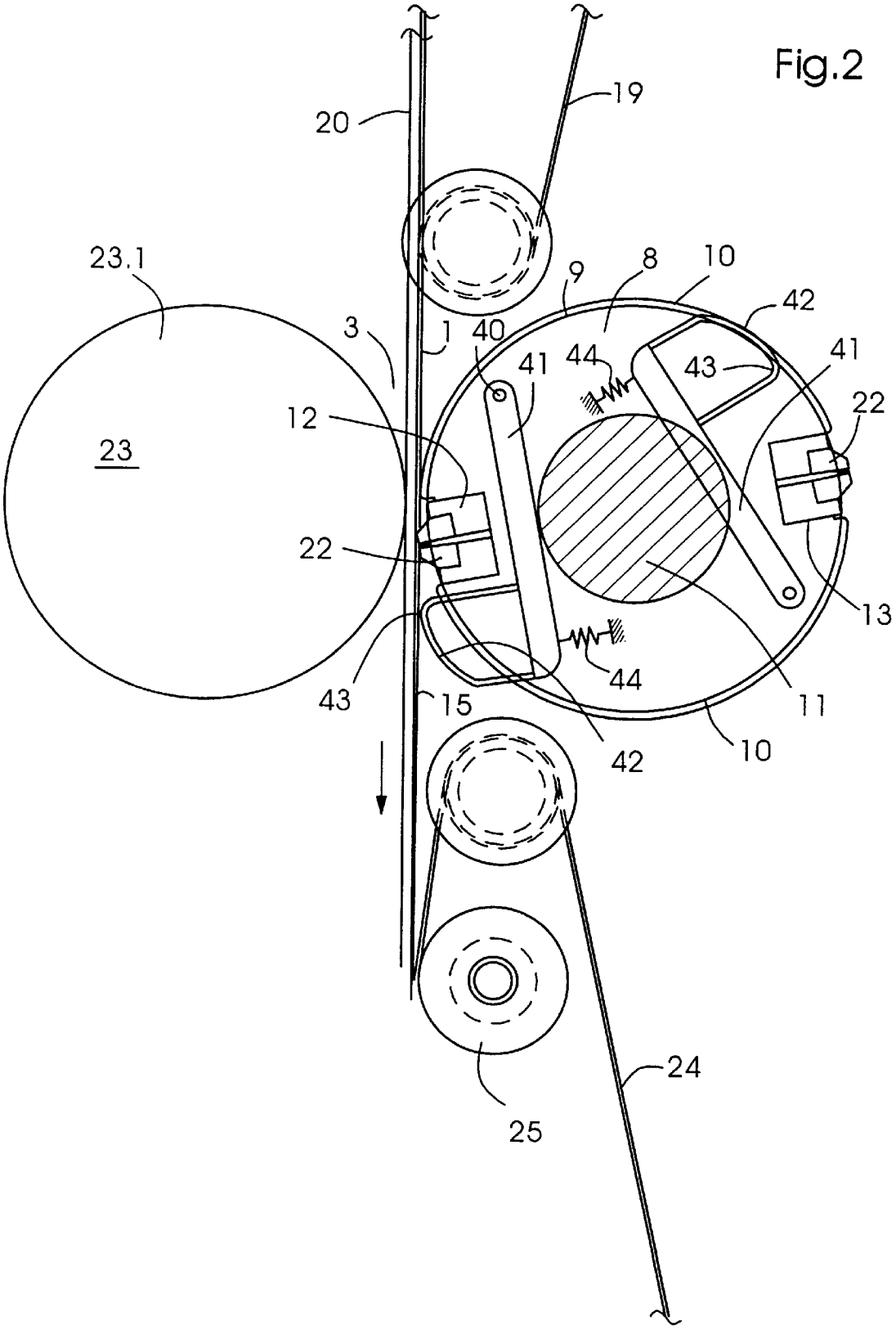

FIG. 2 shows a transport belt having cutting rubber portions assigned thereto.

In this figure a conventional knife cylinder 8 is shown to cooperate with a transport belt 20 travelling along a supporting element surface 23.1. Said knife cylinder 8 is provided with two knife assemblies 12, 13, respectively, and its surface is covered with two surface jackets 10 arranged opposite of each other. Said knife assemblies 12, 13, respectively, each comprise cheekwoods 22 between which a knife is fastened to cooperate with said transport belt 20 having cut rubber portions 20.1 and forming an anvil upon a cutting operation. The web travel path is constituted by transport belts 20, cooperating with constraining tapes 19 in the region above said knife cylinder 8. Below said knife cylinder 8 a further transport system 18 is arranged, said transporting said cut signatures 15 for further processing thereof; said knife cylinder 8 includes pivotally mounted cams 41, movably mounted about pivot axis 40. Said cams 41 each comprise cam surface portions 42 including contacting portions 43. Said cams 41 are connected to spring means 44. In the state shown in FIG. 2, said contacting portions 43 seize said trailing edge of said signature 15 after said signature 15 has been severed from the web of material 1. Said contacting portions 43 keep said respective signatures 15 trailing edge engaged to said surface of said transport belt 20. Said cams 41 are activated by solenoids, pneumatic or hydraulic cylinders or electric motors to give examples and retracted into the interior of said knife cylinder 8 by means of said spring means 44.

A belt 24 revolving about an endless loop, is routed about deviation roller 25, said belt 24 seizing the cut signatures 15 between its respective surface and the surface of said transport belt 20 bridging the above-mentioned signature cutting region 3.

Figure 3A:
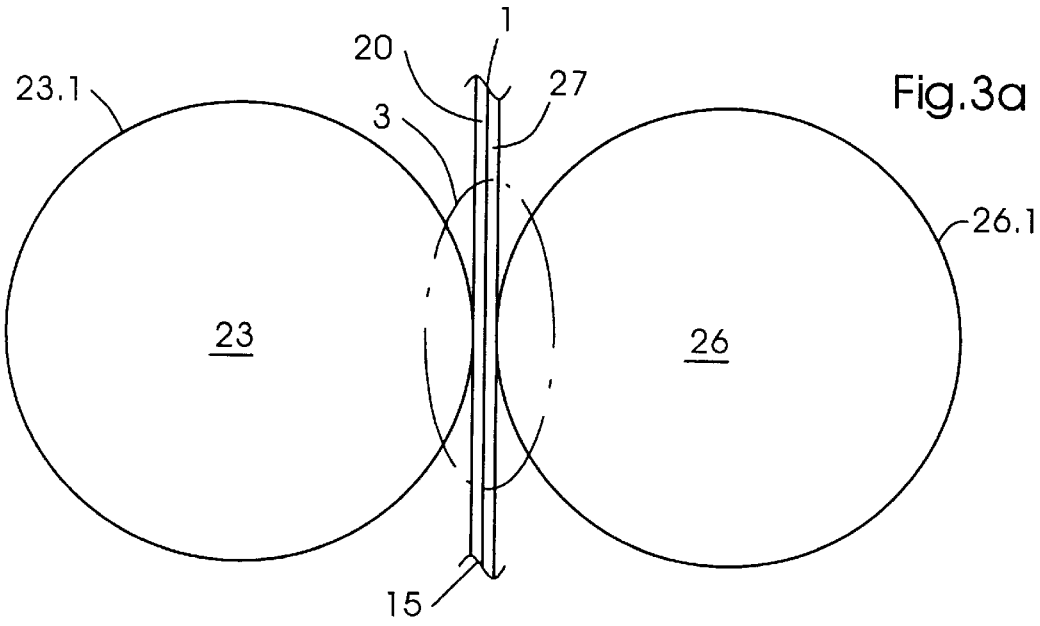

FIG. 3*a* shows an embodiment of the present invention in which a cutting region is defined between two downstream travelling belts said belts being supported by a first and a second supporting element.

This embodiment according to the present invention offers the significant advantage to have an incoming web of material 1 constrained between two seizing surfaces, permitting no relative movement between said incoming web 1. The same is true for the portion of the travel path downstream of said cutting region 3. The cut signatures 15 are seized between the two surfaces of said belts 20, 27, respectively, eliminating any relative movement of said cut signatures 15 within each revolving path of said belts 20, 27, respectively a supporting element 23, 26 is provided having a flat surface and supporting said revolving belts 20, 27 within said cutting region 3 upon a cutting operation.

Figure 3B:
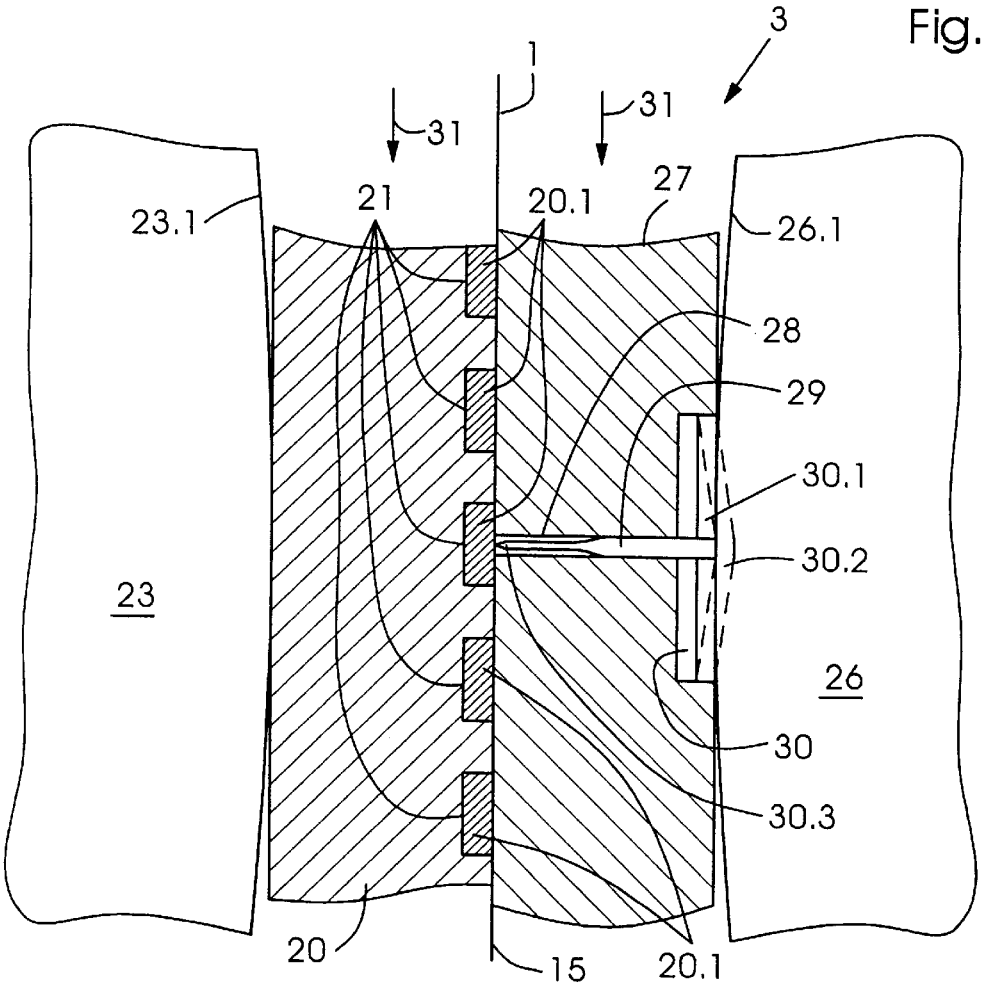

FIG. 3*b* shows said cutting region according to the present invention in an enlarged scale.

Within said cutting region 3 said revolving belts 20, 27 are supported by said surfaces 23.1, 26.1, respectively, of said rotating supporting elements 23 and 26, respectively. Said flat surfaces 23.1, 26.1, respectively, serve as cutting pressure generation members, only exerting a force upon said revolving belts 20, 27, respectively, upon a lateral cutting operation. Both belts 20, 27, respectively, travel in the direction as indicated by arrow 31 in FIG. 3*b*. For example, said transport belt 20 travelling in direction 31 being supported by said first supporting element 23 may include lateral grooves 21 into which cut rubber portions 20.1 are integrated. Said cut rubber portions 20.1 may be spaced from one another as shown in FIG. 3*b*. In the alternative, a continuous cut rubber layer may be arranged on said transport belt being a cutting anvil upon activation of said cutting element 29 mounted in a belt assembly 27. The belt assembly 27, as shown in FIG. 3*b*, includes a belt member having a multi-layered structure in which said layers comprise an opening 28, receiving cutting elements 29. Said cutting elements 29, for example, have a T-shape, a portion of which is secured in a respective recess of said belt assembly 27. A knife base 30 being mounted within said recess, having resilient properties allows for activation and deactivation of said knife tip 30.3. Reference numeral 30.2 depicts the respective position of the knife base 30 when said knife base 30 is not supported by said second supporting element's surface 26.1. In this stage (shown in dashed lines) said knife tip 30.3 does not protrude from said opening 28 does not severe a signature 15 from said incoming web 1. In the activated stage of said knife base 30 depicted with reference numeral 30.1, said cutting element 29 is activated, therefore said knife tip 30.3 will severe a signature 15 from the respective leading edge of said incoming web of material 1. In this stage said knife base 30 is supported by said second supporting element surface 26.1. Upon further downstream movement of said belt assembly 27 said knife base 30 will move downwards, thus leaving the second supporting element surface 26.1. Consequently, the knife base 30 serving as a spring means, will adopt its disengaged position 30.2, thus the knife tip 30.3 will stay inside its respective opening 28.

Said transport belt 20 and said belt assembly 27, respectively, will be driven such that they are synchronized with respect to one another and upon a cutting operation, a knife tip 30.3 protrudes into a cut rubber portion 20.1.

Figure 4:
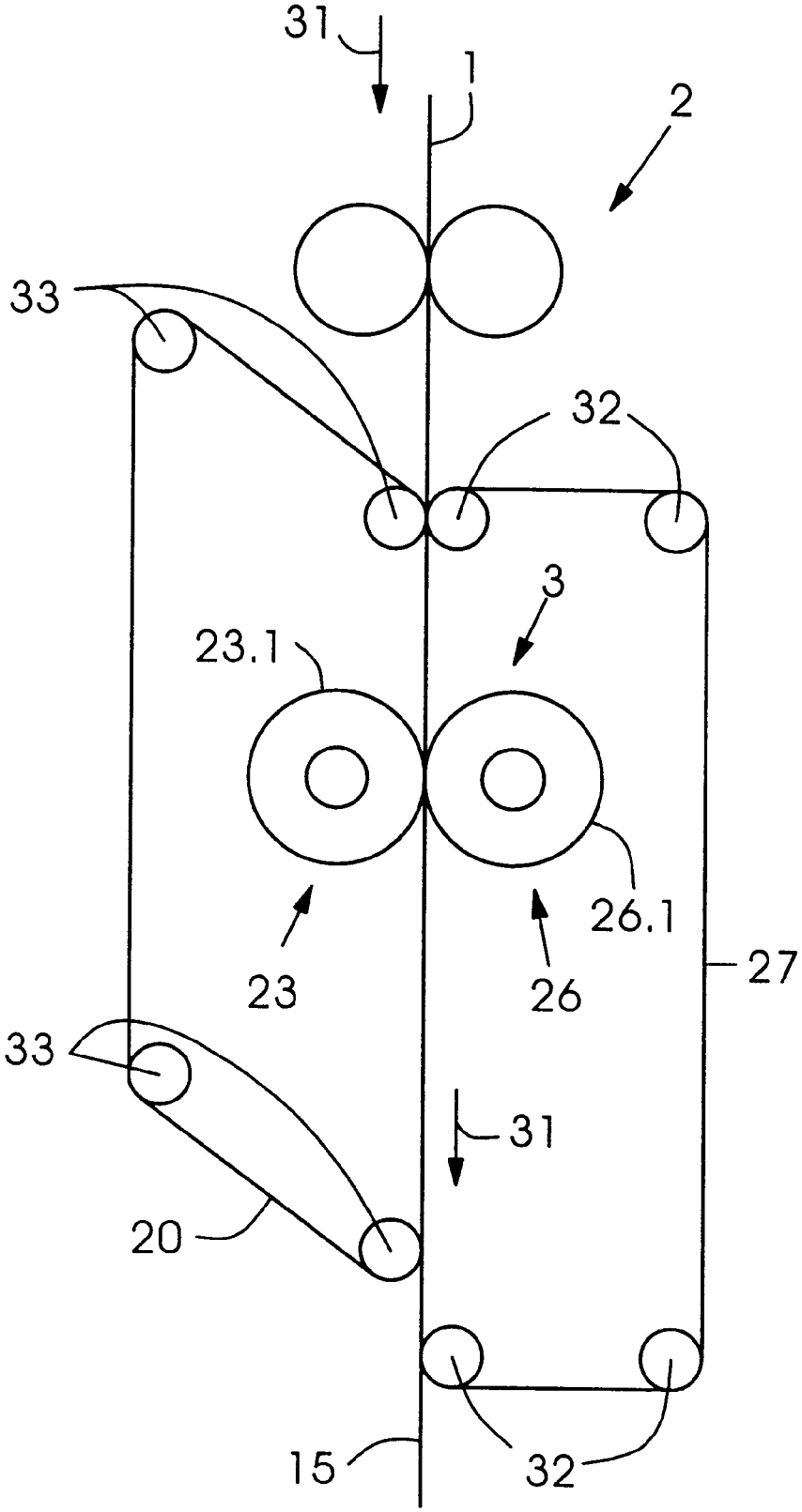

FIG. 4 discloses the respective loops along which said transport belt and said belt assembly continuously revolve.

Said travelling web of material 1 is captured by a pair of nip rollers 2, and is seized between a transport belt 20 and a belt assembly 27. Both belts 20, 27 respectively, revolve along endless loops being guided by a plurality of deviation rollers 32, 33, respectively. Said transport belt 20 may be driven separately from said belt assembly 27 and a separate drive may be assigned to said belt assembly 27. Both supporting members 23, 26, respectively, may either be driven by the drive of the respective transport belt 20 or said belt assembly 27 or even may have their own drives. It is understood that said transport belt 20 extends about the maximum lateral width of the web to be processed, which is true for the belt assembly 27 as well. The arrangement according to FIG. 4 of the present invention is included in a folder apparatus, for example, assigned to a web-fed rotary printing press.

Figure 5A:
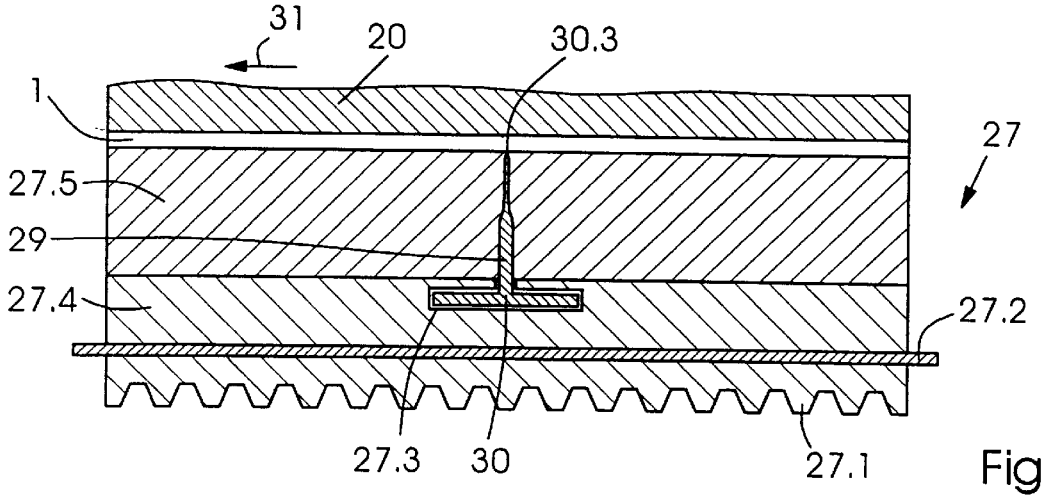

FIG. 5*a* shows an embodiment of a knife integration into a belt assembly according to the present invention, being mounted into a base substrate layer of said belt assembly.

In this embodiment of the present invention, the multi-layered structure of the belt assembly 27 is shown in an enlarged scale. An incoming web of material 1 is seized between said surface of said transport belt 20 and uppermost layer of a belt assembly 27. In the example of a belt assembly 27, said assembly 27 includes a substrate base layer 27.4 having a plurality of teeth 27.1 arranged adjacent to one another. Above said substrate base layer 27.4 a layer of compressible material 27.5 is arranged, contacting the respective incoming web of material 1, in the alternative said cut signature 15. Said substrate layer 27.4 comprises a T-shaped opening 27.3 for receiving said cutting elements 29, knife base 30, further said substrate base layer 27.4 is provided with a reinforcing member 27.2 extending in substantially longitudinal direction of said belt assembly 27. Said reinforcing member 27.2 may be cords, fibres, i.e. Kevlar-fibres or an other suitable reinforcing materials. Embedded in said T-shaped opening 27.3 in said substrate layer 27.4 are cutting elements 29. The knife tip 30.3 in the stage shown in FIG. 5*a* is not in a cutting operation, but rather fully surrounded by said compressible layer 27.5.

Figure 5B:
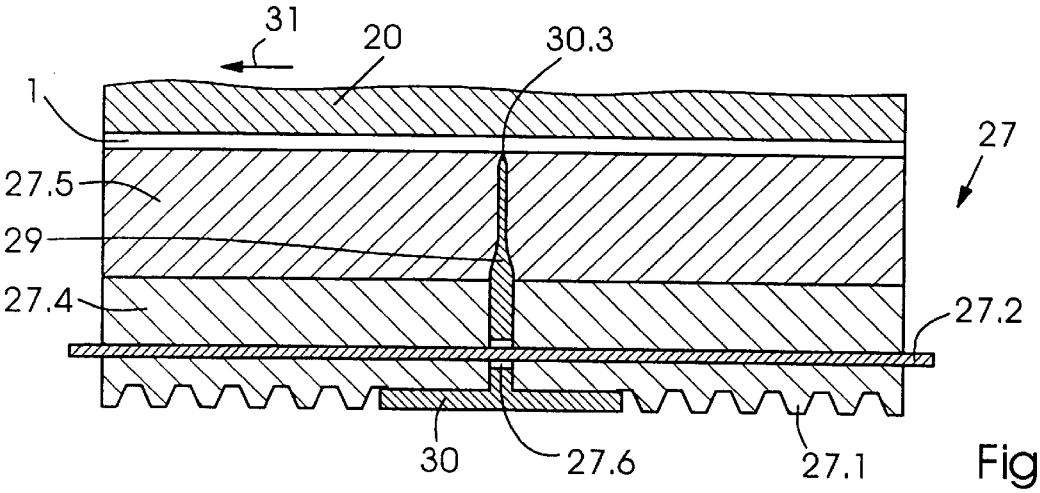

In FIG. 5*b* a further embodiment of a knife integration into a substrate layer of a belt assembly on a reinforcing member is shown.

Said belt assembly 27 may comprise an upper compressible layer 27.5 contacting said incoming web of material 1 and a further substrate layer 27.4. Said substrate base layer 27.4 includes a plurality of teeth 27.1 to facilitate movement of said belt assembly 27 about deviation rollers of smaller diameter. Between said teeth on the bottom of said substrate base layer 27.4 a recess is provided, which receives said knife base portion 30 of said cutting elements 29. In this embodiment of said cutting elements 29 notches 27.6 are provided through which said above-mentioned reinforcing members 27.2 extend to secure said cutting element 29 to said belt assembly 27. The blade portion of said cutting element 29 extends through both layers, i.e. said substrate base layer 27.4 and said compressible layer 27.5. In the stage shown in FIG. 5*b* the respective knife tip 30.3 is not shown in a cutting operation, but rather in a transport position to allow a portion of said incoming web of material 1 to pass.

Figure 5C:
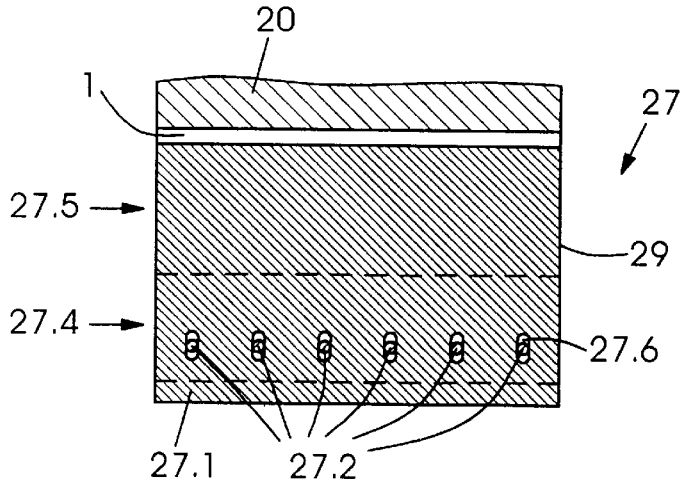

In FIG. 5*c* of the present invention a cross-sectional view of said knife mounting according to FIG. 5*b* is given.

Said reinforcing members 27.2 shaped as cords or fibres extend through said notches 27.6 of said cutting elements 29. In the cross section according to FIG. 5*c* said cutting elements 29, knife tip 30.3 does not contact the lower surface of said web 1 to be cut, but rather stays completely surrounded by the respective layers 27.4, 27.5, respectively of said belt assembly 27.

Figure 6A:
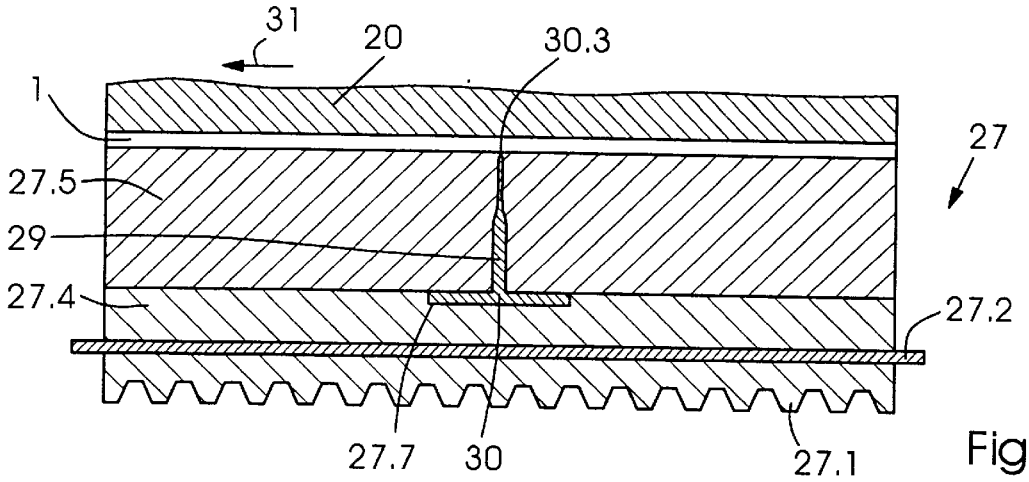

In FIG. 6*a* the cutting elements integration according to the present invention is given in an example where said cutting element's base is received in a lateral groove of one layer of said belt assembly.

In this embodiment said cutting element 29 having a base 30 is received in a lateral groove 27.7 of said substrate layer 27.4. On top of said substrate base layer 27.4 said compressible layer 27.5 is arranged, securing said knife base 30 on top of said substrate base layer 27.4. Said substrate base layer 27.4 is penetrated by said reinforcing member 27.2 and includes a tooth-configuration 27.1 as previously has been mentioned. In the stage said cutting elements 29 and its respective knife tips 30.3 are fully embedded in said layers 27.4, 27.5, respectively.

Figure 6B:
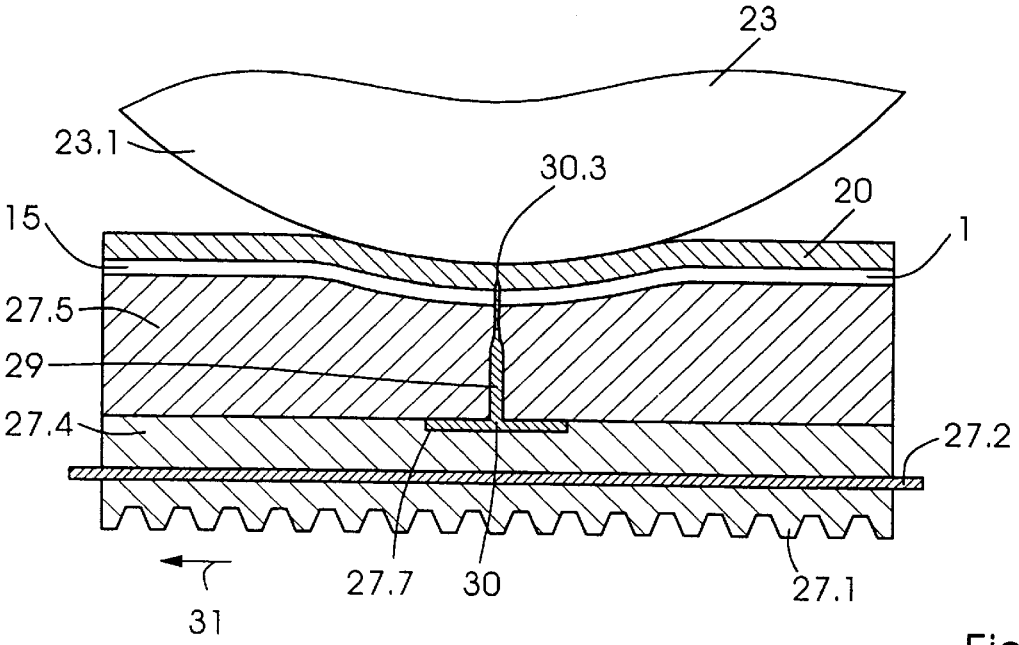

In FIG. 6*b* a knife assembly being mounted in a lateral groove assigned to a substrate base layer of said belt assembly according to the present invention is shown during a cutting operation.

Upon travel into direction 31 an incoming web of material 1 is seized between the surfaces of a transport belt 20 and said compressible layer 27.5. Upon contact of said transport belt 20 with said supporting element's surface 23.1 said transport belt 20 is pushed against said belt assembly 27, thus compressing said compressible layer 27.5. Consequently, said cutting element 29 mounted in said substrate base layer 27.4, for example, will penetrate said incoming web of material 1, thus severing a signature 15 from said web 1. The respective knife tip 30.3 of said cutting element 29 contacts said transport belts 20 surface, either having cut rubber portions integrated therein or having a cut rubber coating assigned thereto both not shown in greater detail here. Upon a cutting operation said compressible layer 27.5 is deformed, thus having the respective knife blade of said cutting element 29 free. Although, not shown in FIG.

6*b*, upon a cutting operation said belt assembly 27 is being supported by the flat surface 26.1 of said second supporting element 26. Since both said transport belt 20 and said belt assembly 27 travel in parallel into direction 31, said cut signatures 15 maintain its relative position with respect of said surfaces of said transport belt 20 and said belt assembly 27. Said cutting elements 29 are recorded in lateral grooves 27 here, but could also be integrated into T-shaped openings, or secured by notches 27.6 to said longitudinally extending reinforcing members 27.2.

According to methods for cutting a web of material said cutting operation can be performed by having a knife base 30 being activated by contact with said flat surface 23.1 of a first supporting element 23. Upon contact with said surface 23.1 said knife base 30 will be deformed thus that said knife tip 30.3 will move out of said belt assembly 27 to penetrate said incoming web of material 1 thus severing a signature 15.

A further method for cutting a web of material is having an incoming web of material 1 supported by a transport belt 20 being pushed against said belt assembly 27. If said belt assembly 27 includes a compressible layer 27.5, said layer surrounding the knife blade of said cutting element 29 is compressed said knife tip 30.3 protrudes and upon contact with said transport belt 20 severs a signature 15 from said incoming web of material 1.

Figure 7:
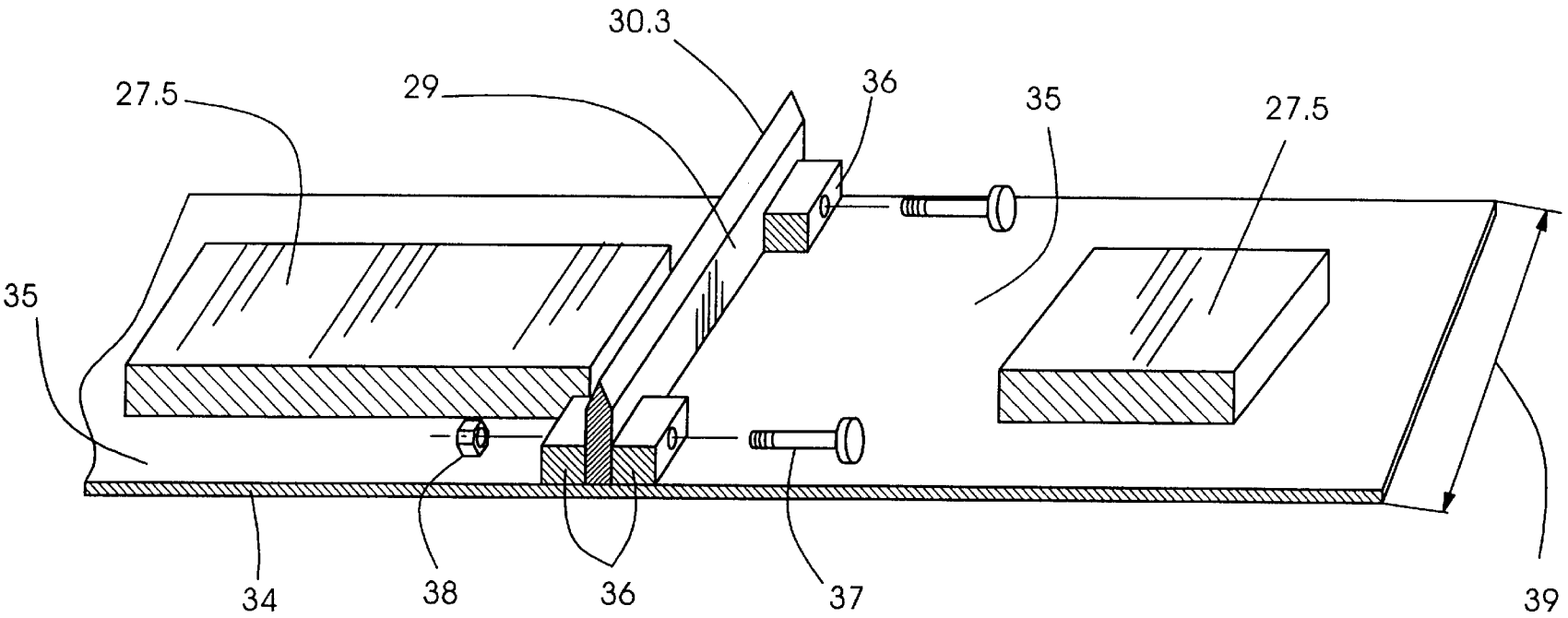
FIG. 7 shows a further embodiment of a knife integration into a revolving belt assembly.

FIG. 7 shows a further embodiment of a knife integration into a revolving belt assembly.

A metal belting 34 rotating about an endless loop such as said belt assembly 27 described in FIG. 4 of the instant application. Said metal belting 34 includes a surface portion 35 onto which blocks 36 are mounted for example by a welding process. Said knife 29, the knife tip 30.3 of which severs said signatures 15 from a web of material 1 is mounted between said block 36. Said block 36 may be assigned to lateral edge portions of said metal belting 34 extending over a width indicated by reference numeral 39. Said knife 29 may be mounted to said block 36 by bolts 37 secured with a nut-shaped member 38 to allow for easy replacement of said knife 29 from said metal belting 34. Adjacent to said replaceable knife 29 according to FIG. 7 compressible layer portion 27.5 extend to the next replaceable knife 29 arranged on said metal belting 34. For reasons of clarity said right hand side compressible layer portion 27.5 has been shown moved away from said replaceable knife 29.

Although, not shown in greater detail here, the present invention is extremely useful in a processing apparatus such as a folder assigned to a web-fed rotary printing press.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for cutting webs of material, including:

a first revolving member;

a second revolving member having cutting elements integrated therein; and a first supporting element and a second supporting element, defining a cutting region therebetween, each having surfaces for supporting said revolving members against each other within said cutting region, thereby activating said cutting elements, and said revolving members are located between said first and second supporting elements.

2. Apparatus according to claim 1, wherein said first revolving member is a transport belt revolving about an endless loop.

3. Apparatus according to claim 1, wherein said second revolving member is a layered structure revolving about an endless loop.

4. Apparatus according to claim 2, wherein said first supporting element is integrated into said endless loop of said first revolving member about deviation rollers.

5. Apparatus according to claim 3, wherein said second supporting element is integrated into said endless loop of said second revolving member about deviation rollers.

6. Apparatus according to claim 1, wherein said second revolving member comprises an opening assigned to each of the cutting elements.

7. Apparatus according to claim 1, wherein said first and second revolving members, respectively, have a multi-component structure.

8. Apparatus according to claim 7, wherein said first revolving element is a belt comprising a plurality of laterally extending cut rubber portions.

9. Apparatus according to claim 7, wherein said second revolving element is a belt assembly comprising a substrate layer.

10. Apparatus according to claim 9, wherein said substrate layer has a substantially flat surface contacting said second supporting element.

11. Apparatus according to claim 9, wherein said substrate layer has a toothed surface facing inwards with respect to an endless loop.

12. Apparatus according to claim 9, wherein said substrate layer includes a reinforcing member.

13. Apparatus according to claim 12, wherein said reinforcing member substantially extends in a longitudinal direction of said substrate layer.

14. Apparatus according to claim 12, wherein said reinforcing member is a cord.

15. Apparatus according to claim 12, wherein said reinforcing member is comprised of fibres.

16. Apparatus according to claim 12, wherein said reinforcing member is comprised of Kevlar-fibres.

17. Apparatus according to claim 9, wherein said substrate layer includes a mounting groove for said cutting elements.

18. Apparatus according to claim 17, wherein said mounting groove is a T-slot, surrounding a knife base of said cutting element.

19. Apparatus according to claim 17, wherein said mounting groove is arranged on top of said substrate layer.

20. Apparatus according to claim 17, wherein said mounting groove is arranged on a bottom of said substrate layer.

21. Apparatus according to claim 12, wherein said reinforcing members secure said cutting elements onto said substrate layer.

22. Apparatus according to claim 12, wherein said reinforcing member extends through openings of said cutting elements, embedding said cutting elements within said substrate layer.

23. Apparatus according to claim 1, wherein at least one of said cutting elements has a flexible knife base.

24. Apparatus according to claim 23, wherein said spring-shaped knife base is activated upon impact thereof with a surface of a second supporting element.

25. Apparatus according to claim 23, wherein said spring-shaped knife base is released upon disengaging of said knife base from a surface of a supporting element.

26. Folder having an apparatus for cutting webs of material including:

a first revolving member;

a second revolving member having cutting elements integrated therein; and supporting elements, defining a cutting region therebetween, each having surfaces for supporting said revolving members against each other within said cutting region, thereby activating said cutting elements, and said revolving members are located between said first and second supporting elements.

* * * * *